United States Patent [19]

Vergne

[11] Patent Number: 4,756,475

[45] Date of Patent: Jul. 12, 1988

[54] GAS-FIRED BOILER

[75] Inventor: Bernard Vergne, Palaiseau, France

[73] Assignee: Elettro Termica Sud S.p.A., Tito, Italy

[21] Appl. No.: 22,528

[22] Filed: Mar. 9, 1987

[30] Foreign Application Priority Data

Mar. 7, 1986 [FR] France ..... 86 03236

[51] Int. Cl.[4] ..... F24D 3/00

[52] U.S. Cl. ..... 237/56; 237/8 R

[58] Field of Search ..... 237/16, 19, 53, 50, 237/56, 8 R; 126/101, 110 B, 110 C; 122/20 B

[56] References Cited

FOREIGN PATENT DOCUMENTS 584 7/1978 European Pat. Off. ..... 237/56
2119738 8/1972 France .
2126471 10/1972 France .
63141 8/1968 German Democratic Rep. ... 237/56

*Primary Examiner*—Henry A. Bennet
*Attorney, Agent, or Firm*—Young & Thompson

[57] ABSTRACT

The boiler, which is of the wall-mounting kind, comprises: a burner connected to a gas supply part; a combustion chamber; a heat exchanger; distribution, exchange and control components and communicating passages between them; inlet and outlet lines connected to the exchanger; and external connections. The distribution, exchange and control components are combined on a common mounting plate which comprises some of the functional elements of each component and in which the connecting passages for each component extend, such passages being in the form of internal passages in the mounting plate. Of use for facilitating assembly and maintenance and reducing the risk of leakages.

13 Claims, 5 Drawing Sheets

GAS-FIRED BOILER

This invention relates to a gas-fired boiler comprising: a burner connected to a gas supply path; a combustion chamber in which a combustion gas/water heat exchanger connected to cold water inlet and hot water outlet paths of a space-heating circuit is disposed opposite the burner; a hot water service path; distribution, exchange and control components in such paths; and a set of junctions between the paths and the exterior.

The distribution, exchange and control components comprise, for example: a pump or circulator upstream of the combustion gas/water exchanger; an air bleeding valve upstream of the pump; a three-port valve via which the cold water inlet line communicates either with a junction associated with space-heating radiators or with a bypass connected to the hot water outlet line by way of a water/water exchanger which is another of the components mentioned; a rate-of-flow detector for the hot water service, such detector being disposed in a hot service path which also extends by way of the water/water exchanger between two junctions with the hot service circuit of the installation; a rate-of-flow detector for the water in the combustion gas/water exchanger; and a combustion-controlling box disposed in the gas supply path.

In known boilers these components are dispersed in a boiler casing and are interconnected by respective water and gas ducting.

Boiler assembly is very difficult to automate. Also, when maintenance work is required, for any of the components to be demounted the ducted junctions must be disconnected and work usually has to be carried out in a very inconvenient manner due to the unsatisfactory arrangement.

In the boiler according to the invention, the gas supply path, the cold water inlet and hot water outlet paths and the hot water service paths are each embodied at least to some extent as internal passages in a common mounting plate disposed between the burner and the set of junctions; and the distribution, exchange and control components comprise an individual part releasably secured to the mounting plate.

As many components as required can therefore be combined on the mounting plate, the same serving as a kind of common head-block for the components. For maintenance work the individual releasable part of each component can be demounted from the mounting plate so that there is direct access to the inside of the component without any need to touch the junctions on the mounting plate. Considerable time is therefore saved as compared with the prior art method wherein the component first had to be removed from the boiler, then dismantled.

The position proposed for the mounting plate in the boiler is very accessible. Consequently, all the components on the mounting plate are very accessible, thus further simplifying working.

Assembly of the components on the mounting plate in manufacture can be automated and particularly robotized very readily, whereafter the mounting plate with the components on it can be fitted in the boiler.

Other features and advantages of the invention will become apparent from the following description.

In the accompanying exemplary and non-limitative drawings.

Figure 1:
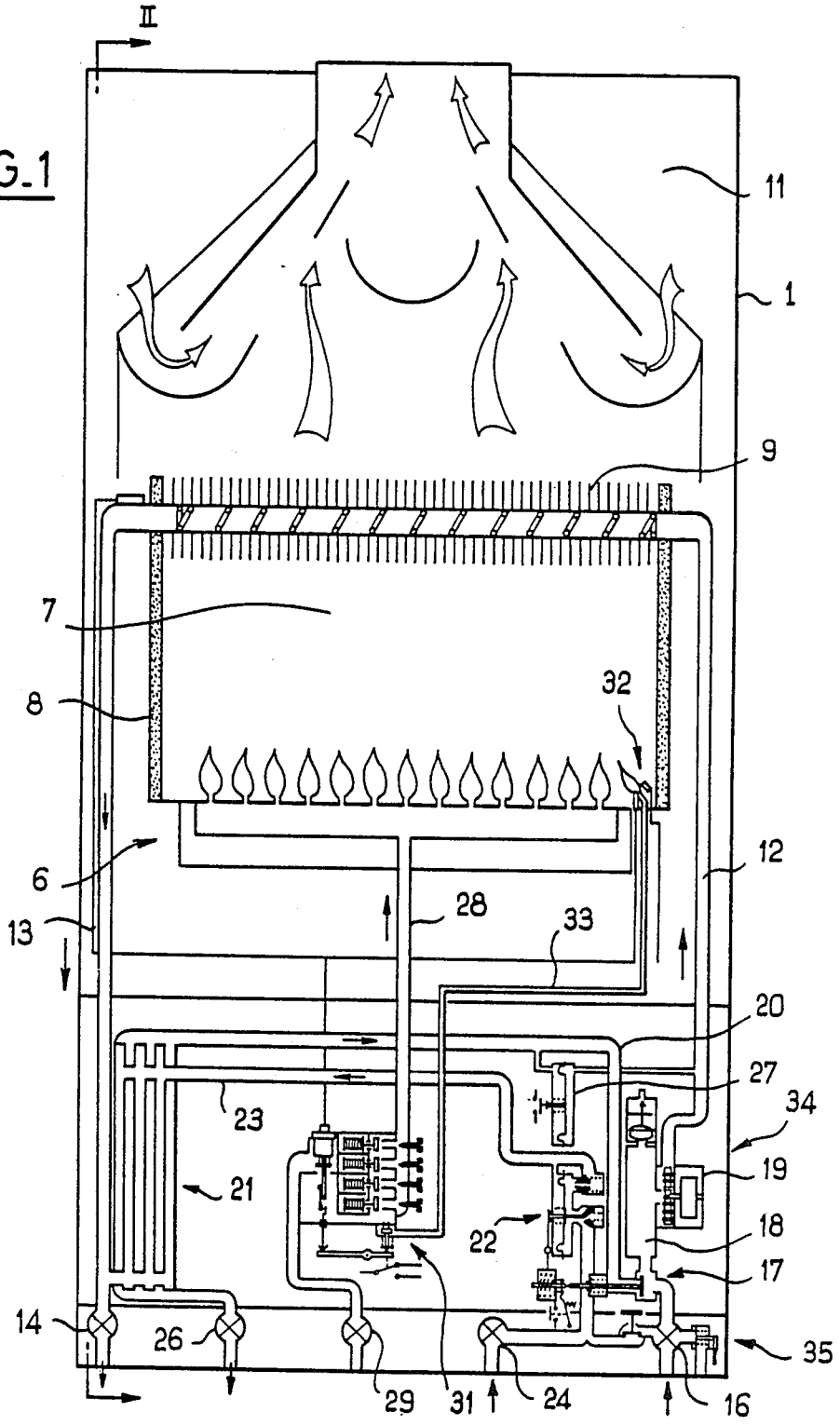
FIG. 1 is an operating diagram of a wall-mounting boiler according to the invention.
Figure 2:
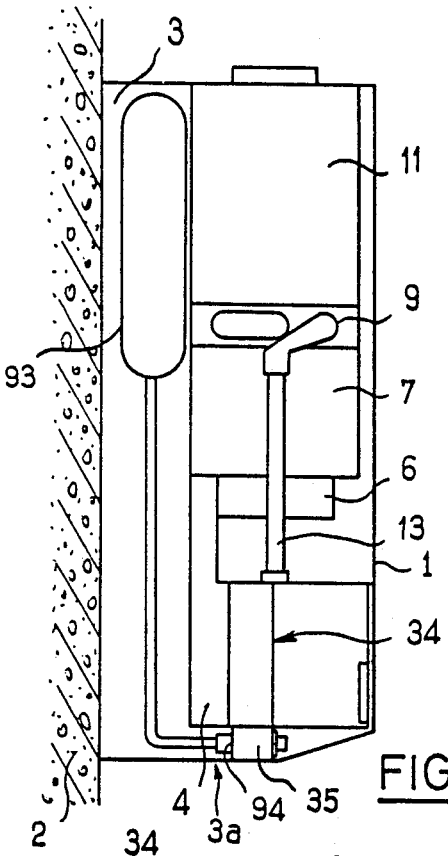
FIG. 2 is a diagrammatic view of the boiler on the line II—II of FIG. 1.

In the example shown in FIGS. 1 and 2, a boiler having an e.g. sheet-metal casing 1 is adapted to be supported by a substantially horizontal bottom member 3*a* of a rear boiler support frame 3 which can be seen in FIG. 2 and which is adapted to be secured to a vertical wall 2.

The boiler casing 1 which is operative as a frame comprises an intermediate frame 4 which in operation is adjacent the support frame 3 and which carries a burner 6. Disposed thereabove is a combustion chamber 7 around which a heat-resistant and heat-insulating cladding 8 extends. Disposed at the top of combustion chamber 7 is a combustion gas/water exchanger 9 above which there is an anti-back-flowing device 11 ensuring satisfactory discharge of the combustion gases.

The "water" path of the exchanger 9 is disposed between a cold water inlet line 12 and a hot water outlet line 13. The hot water outlet line 13 communicates with a valve 14 controlling delivery to a hot water supply circuit for space-heating radiators.

The boiler also comprises a valve 16 which in operation communicates with a cold water return circuit from the heating radiators. The valve 16 is connected selectively to the cold water inlet line 12 through a three-port valve 17 disposed between the valve 16 and an air bleeding valve 18 communicating with the inlet of a pump or circulator 19 delivering to line 12.

When the valve 17 isolates the line 12 from the valve 16 the line 12 communicates with a bypass 20 to which the hot water outlet line 13 delivers by way of one of the paths of a water/water heat exchanger 21. When the valve 17 interrupts communication between the valve 16 and the line 12, the line 13 ceases to be able to deliver to the circuit connected to the valve 14 since the same is closed at the other end by the valve 17. The pump 19 then provides a closed-circuit flow by way of the line 12, exchanger 9, line 13, exchanger 21, bypass 20, valve 17 and valve 18.

The valve 17 is controlled automatically by a rate-of-flow detector 22 connected in series with the other path of the exchanger 21 in a hot water service path 23 extending between a valve 24 providing an inlet connection and a valve 26 providing a connection to the outlet. The detector 22 is disposed between the valve 24 and the exchanger 21.

Consequently, when there is no flow through the path 23 the valve 17 takes up the position which is shown in FIG. 1 and in which the lines 12, 13 communicate with the radiator-heating circuit. When a user opens a hot water tap of the hot service, water flows through the path 23 and such flow is detected by the detector 22 which changes the valve 17 over to its other position. The closed circuit hereinbefore referred to is then established and the water for the hot service is heated in the exchanger 21.

Another rate-of-flow detector 27 is connected to the line 12 and bypass 20—i.e., to the line 13 via the exchanger 21. The detector 27 detects the pressure difference between these two positions to cut off the supply when such difference is zero —i.e., when there is zero flow through the exchanger 9.

The gas supply of the burner 6 is by way of a gas supply path 28 communicating by way of a valve 29 with the mains supply by way of a combustion control box 31. The burner 6 also comprises a pilot light facility 32 connected to the casing 31 by a pilot line 33.

According to the invention, the distribution, exchange and control components comprising the valves 17, 18, circulator 19, exchanger 21, detectors 22, 27 and control box 31 are mounted on a common mounting plate 34 which, as shown diagrammatically in FIG. 2, is carried vertically by the intermediate frame 4 between the burner and a junction set 35 carried by member 3*a* of the boiler support frame 3 at the bottom of the boiler. the junction set 35 carrying the valves 14, 16, 24, 26, 29.

A description will now be given in greater detail of the mounting plate 34 and the components thereof with references to FIGS. 3–10.

The mounting plate 34 is a metal casting (see FIGS. 5–9) to whose front surface a releasable individual part of each component is secured. After such securing the mounting plate 34 supplements the components to make them a functional unit. Also, the plate 34 and each component are so devised that the fluid communications between each component and the remainder of the boiler are effected in that part of the component formed by the mounting plate, so that the releasable part of the components can be separated from the mounting plate, for example, for maintenance, without disassembling the fluid connections.

The mounting plate 34 also comprises internal passages which provide the necessary communications between the various components and between the same and the valves 14, 16, 24, 26, 29. The internal passages also form outlets for the lines 12, 13 connected to the combustion chamber. The gas lines 28, 33 are not in the form of internal passages in the mounting plate since they must be adaptable to the nature of the particular gas used.

Figure 7:
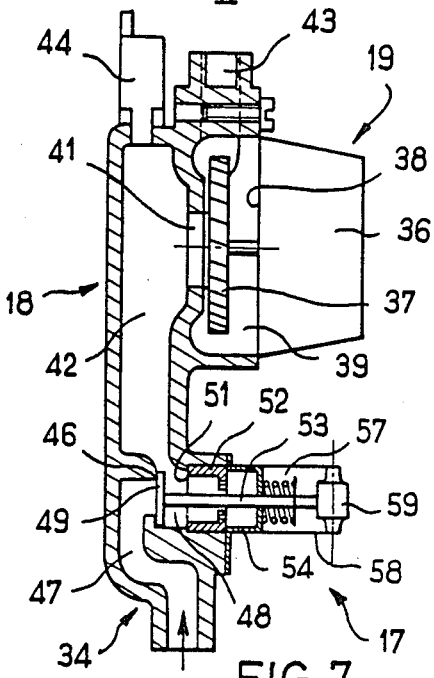
Figure 3:
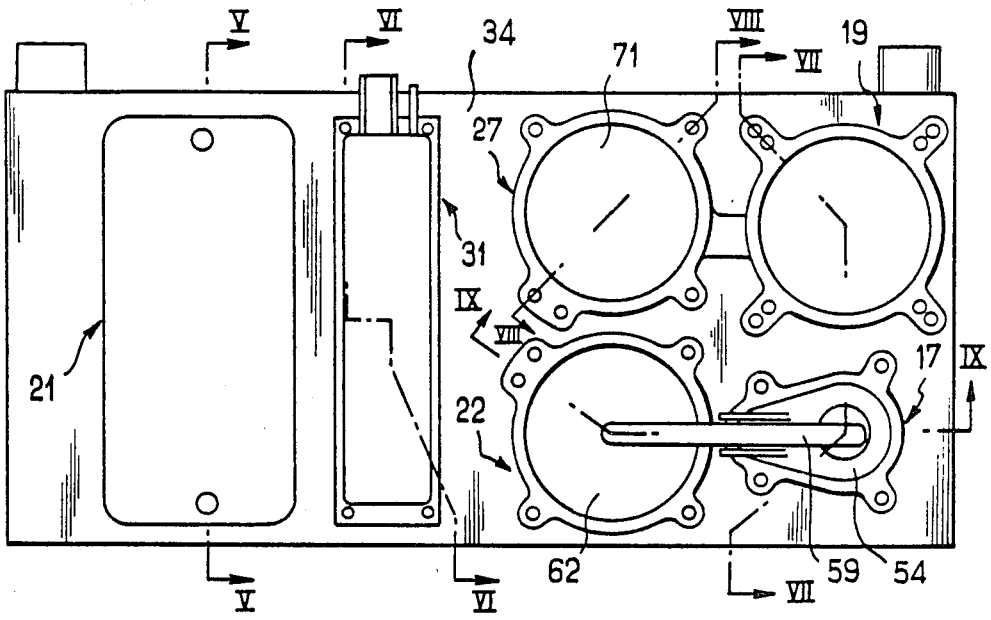
FIG. 3 is a front view of the mounting plate with the components on it.
Figure 4:
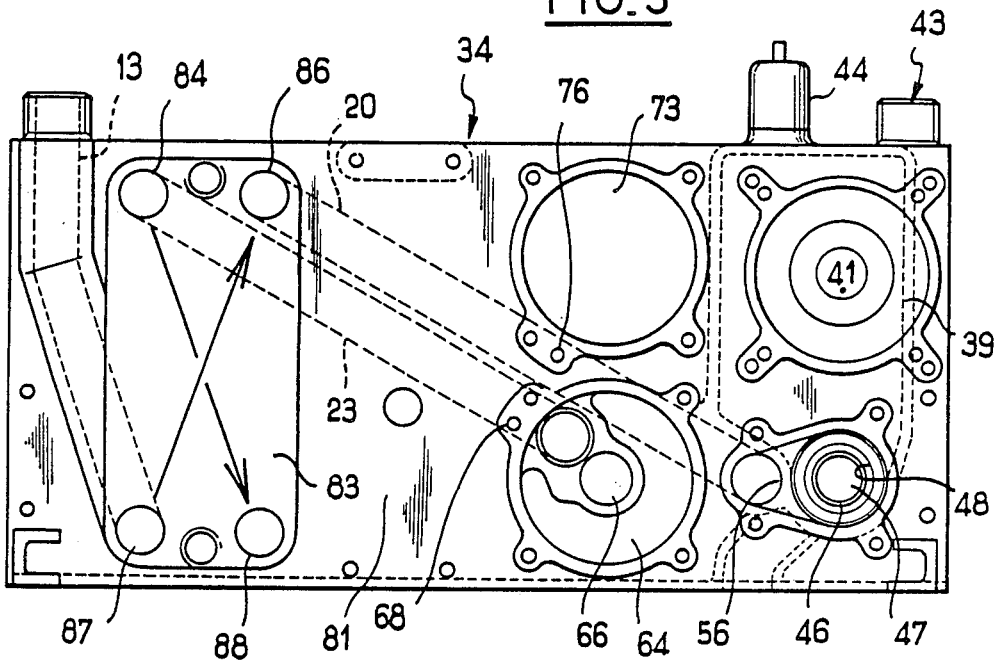
FIG. 4 is a front view of the mounting plate before assembly of the components.
Figure 8:
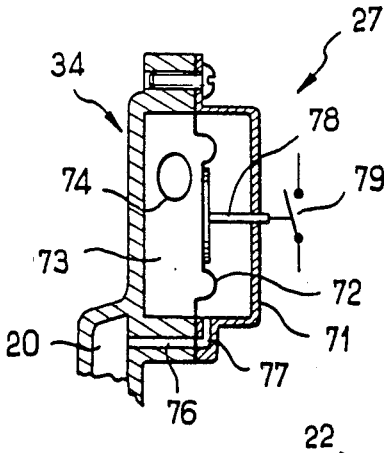

Referring to FIG. 7, the releasable individual part of the circulator 19 comprises the pump motor 36 and the pump rotor 37. Motor casing surface 38 adjacent the rotor 37 hermetically seals a pumping chamber 39 in the form of a recess in the front surface of the mounting plate. An inlet orifice 41 extends axially to the base of the chamber 39 from a cavity 42 in the mounting plate behind the recess 39, the cavity 42 forming part of the air bleeding valve 18. The chamber 39 also communicates with a delivery orifice 43 which is also moulded in the plate 34 and which is operative as an outlet for the line 12.

An automatic bleeder 44 for eliminating any air bubbles arising is connected, as releasable individual part of the bleeding valve 18, to the top of the chamber 42.

The three-port valve 17 has a valve seat 46 contrived in the mass of the plate 34 so as to face the front. The seat 46 extends around the outlet of an internal passage 47 of the plate 34, such passage extending from the valve 16. The chamber 42 extends to a bore 48 which has the seat 46 at its base and which extends to the front surface of the mounting plate.

The releasable individual part of the valve 17 comprises a valve member 49 whose lid is disposed between the seat 46 and a seat 51, the latter being opposite the seat 46 and being carried by a ring 52 fitted in the bore 48 and forming a perforate guide for rod 53 of member 49.

Figure 9:
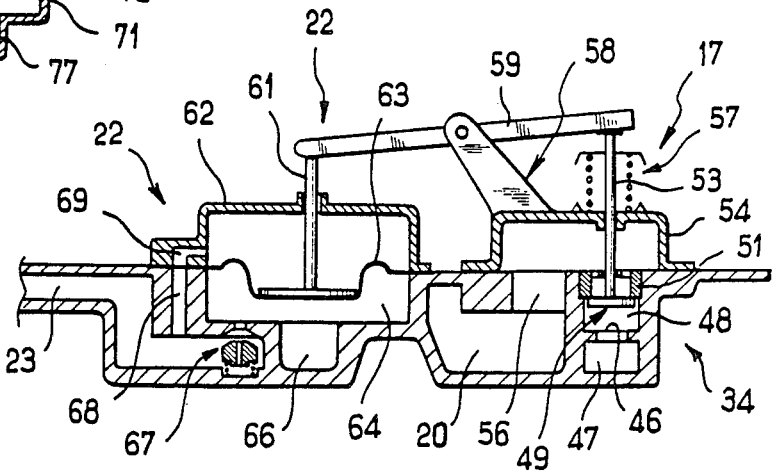
Figure 10:
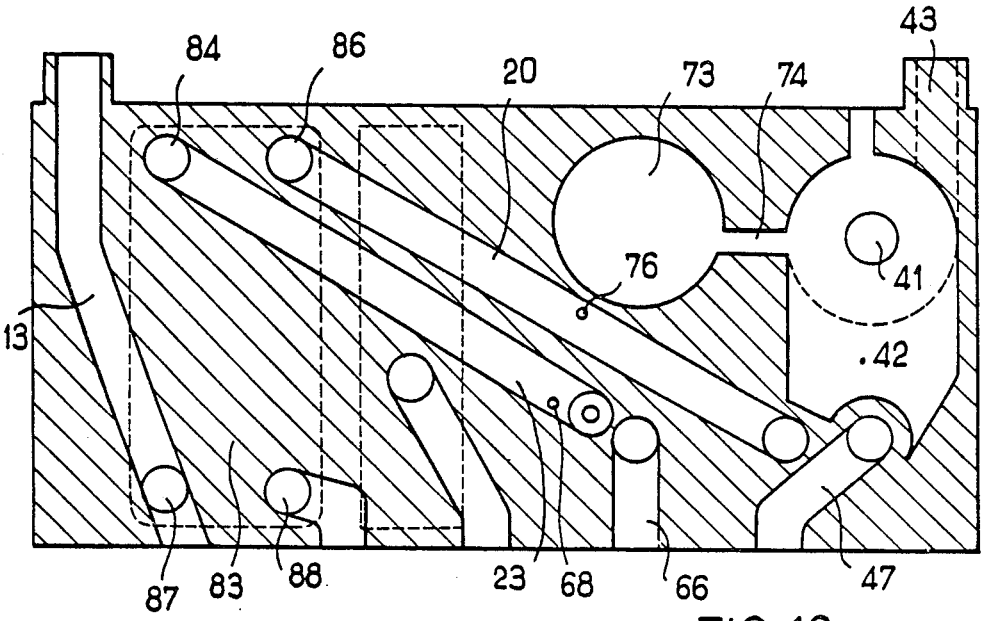
FIG. 10 is a diagrammatic view of the internal passages in the mounting plate, the view being substantially on the line X—X of FIG. 5.

The releasable part of the valve 17 also comprises a half-body member 54 so screwed to the front surface of the plate 34 as to extend around both the bore 48 and a slot 56, visible in FIG. 9, communicating with the bypass 20 embodied by another internal passage in the plate 34. Consequently, when the valve member 49 engages its seat 46, the space 42 communicates with the bore 48, the inside of the half-body 54. the slot 56 and the bypass 20 to embody the closed circuit hereinbefore described, whereas when the valve member 49 engages its seat 51 the passage 47 communicates with chamber 42 of the air bleeding valve in order to supply the exchanger 9 with the cold water return from the heating radiators.

Rod 53 of member 49 extends hermetically through the half-body 54. Return means 57 bearing on the outside of member 54 biases the valve member 49 into engagement with its seat 51. The half-body 54 has a sleeve 58 in which a bent lever 59 is pivotally mounted, one end of lever 59 bearing on the free end of the valve rod 53.

The other end of the lever 59 bears on a rod 61 slidable through a releasable individual half-body member 62 of the rate-of-flow detector 22. Rod 61 is mechanically connected in the member 62 to a diaphragm 63 whose peripheral edge is clamped hermetically between the member 62 and a corresponding plane bearing surface of the mounting plate 34. The latter surface extends around a recess 64 present in the front surface of mounting plate 34 below the member 62 when the same is in position. An inlet passage 66 for cold water for the hot service extends from the valve 24, is one of the internal passages in the mounting plate 34 and extends to the centre of the base of recess 64. Recess 64 also communicates with the internal passage forming the path 23 by way of a nozzle 67. The same is of a known kind which can produce an appreciable pressure drop at a very low rate of flow but not cause an excessive pressure drop when the rate of flow increases. The passage 23 communicates with the inside of the member 62 by way of a bore 68 opening into the plane bearing surface around the recess 64 and through a duct 69 present in the member 62 between the outlet of the bore 68 and the inside of the member 62. The diaphragm 63 is shaped appropriately to act as a seal around the junction between the bore 68 and the duct 69. Consequently, the pressure of the cold water for the hot service as it arrives at the boiler is operative below the diaphragm 63 while above it the pressure downstream of the nozzle 67 is operative. In the absence of flow both pressures are equal and the return means 57 places the valve member 49 in its top position— i.e., it connects the exchanger 9 to the radiator circuit. This is the position shown in FIG. 9. When hot water from the hot service is demanded, the pressure above the diaphragm 63 is decreased by the pressure drop through the nozzle 67 and the diaphragm 63 rises, so that the valve member 49 descends (FIG. 7) and makes the closed circuit for producing hot water for the hot service.

The releasable individual part of the detector 27 comprises a half-body member 71 clamping a diaphragm 72 on a bearing surface which the mounting plate 34 has on its front surface around a recess 73. The same communicates by way of an internal passage 74 with the delivery chamber of the circulator 19. By a system comprising a bore 76 and duct 77 which is identical to the bore 68 and duct 69 described with reference to the detector 22, the inside of the member 71 communicates with the internal passage operative as the bypass 20. A rod 78 is mechanically coupled with the diaphragm 72 and extends hermetically through the member 71 to operate a contact 79 causing the control box 31 to cut off the gas supply when the pressures on both sides of the diaphragm 72 are equal, an indication that there is no flow through the exchanger 9.

The combustion control box 31 (FIG. 6) will not be described in detail since its construction does not form part of the invention. It is secured to a part 81 of the mounting plate 34 and connected by an internal passage 82 to the valve 29.

Figure 5:
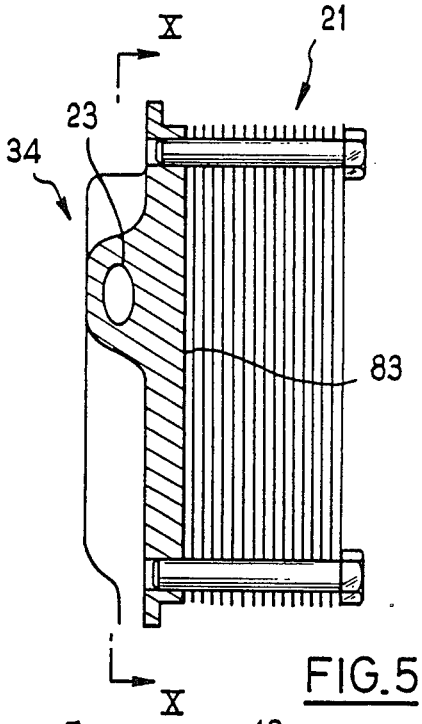
FIGS. 5-9 are views in section on lines V—V, VI—VI, VII—VII, VIII—VIII and IX—IX respectively of FIG. 3.
Figure 6:
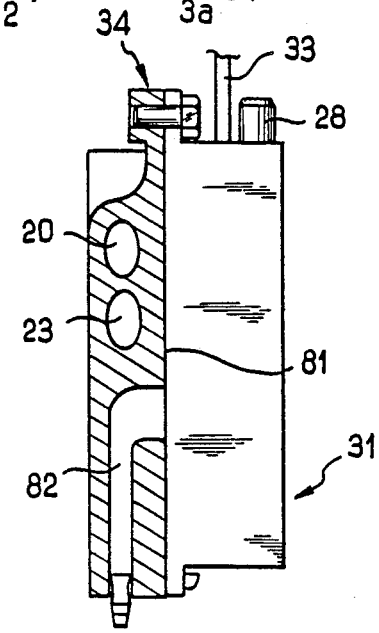

The exchanger 21, visible in FIG. 5, is of the kind comprising releasable plates disposed one above another and screwed to an area 83 of the front surface of the mounting plate 34. Four apertures 84, 86, 87, 88, visible in FIG. 10, respectively connecting the exchanger 21 to the passages 23, 20, line 13 and valve 26 extend through the area 83. The line 13 extends through the plate 34 in the form of an internal passage therein.

A description will now be given with reference to FIGS. 11 and 12 of the junction unit 35 connecting the plate 34 to the gas mains, space-heating system and hot water service of the premises. On the work site the boiler support frame 3 fitted with the unit 35 is secured to the wall. The plumber can therefore connect the unit 35 to the various services without the actual boiler being present. The boiler is positioned subsequently when there is less risk of theft on the site.

The unit 35 comprises a cast metal body 135 operative as a body common to all the valves 14, 26, 29, 24, 16 and formed during casting with the cavities required for the passages connecting the latter valves to junctions **91, 91*b* with the various outside systems, viz. an outlet D for hot water for space heating, a hot water service ECS, gas supply G, a cold water service EFS, a heating-circuit return R and an outlet EU to the sewage system. Junction 91*a* is adapted to be connected by a line 92 (FIG. 2), to an expansion vessel 93 for the heating system, the vessel 93 being disposed near the top of the boiler support frame 3. By way of an internal pasage 90 in the member 135 the junction 91*a* communicates with the chamber of the valve 14**.

The junctions **91, 91*a*, 91*b* are contrived in rear surface 94 of the mounting plate 35—i.e., that surface thereof which in operation faces the wall 2. Manual control elements 96 of the valves 14, 26, 24, 16 are disposed on front surface 97 of the plate 35**, the latter surface being remote from the rear surface just referred to.

Bottom surface 98 of plate 35 carries air bleeders 99 associated with the valves 14, 26, 24, 16, a manual control element 101 of valve 29 and a manual control element 102 of a valve 103 controlling flow through an internal passage 104 in the body 135 between the junction 91 associated with the valve 24 and the valve 16, so that when the valve 103 is open the heating system of the premises can fill up through the passage 104 from the cold water service. The valve 103 includes a non-return feature 106 preventing water from flowing from the heating system to the cold service. However, the heating system can drain into the sewage system if a pressure threshold determined by a pressure-limiting valve 107 is exceeded, such valve controlling the flow through an internal passage 108 in the body 135 between the valve 16 and the junction **91*b***.

Figure 11:
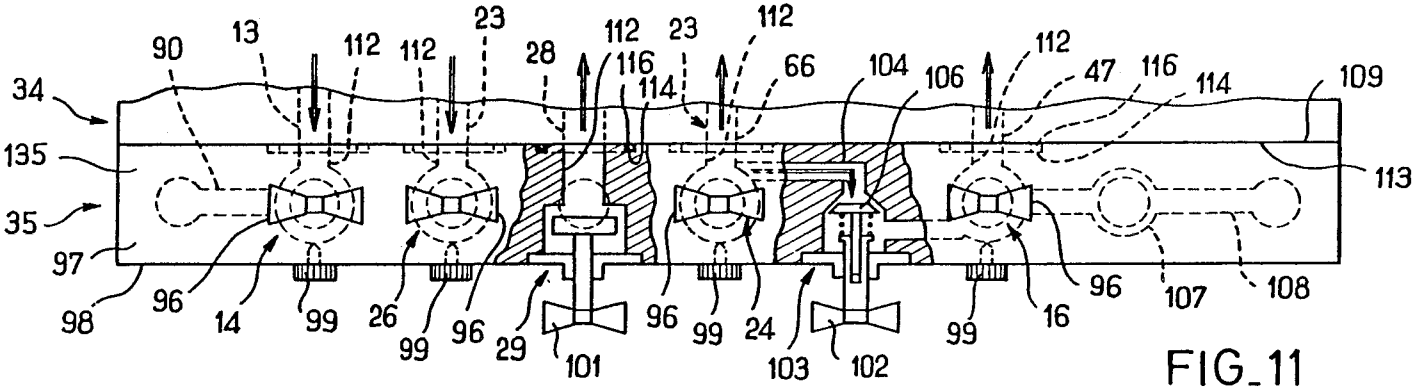
FIG. 11 is a diagrammatic and partly sectioned front elevation of the junction set or unit.
Figure 12:
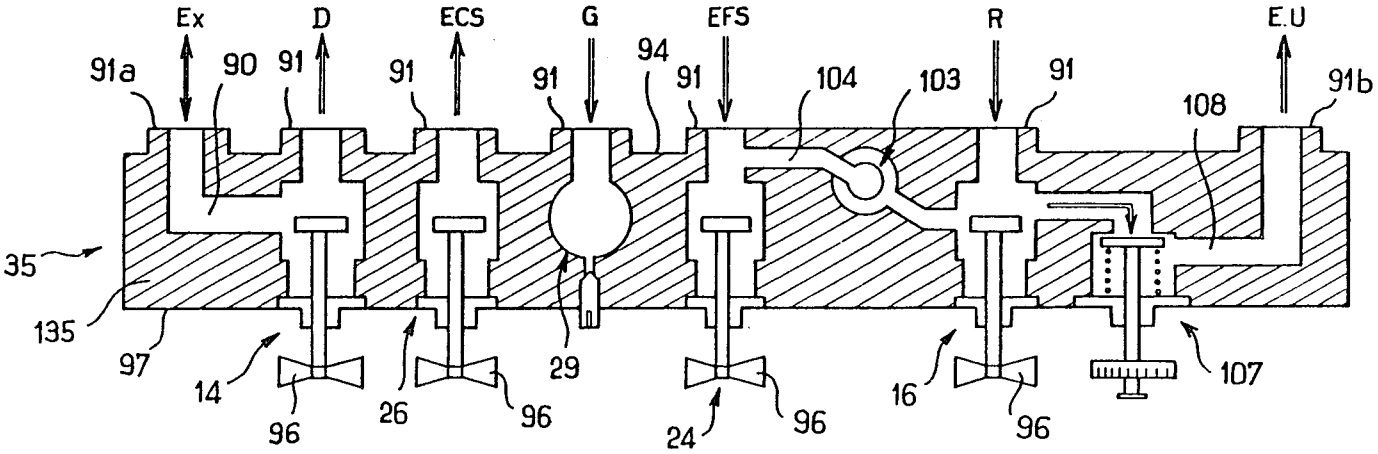
FIG. 12 is a diagrammatic view of the unit in section in a horizontal plane.

Referring to FIG. 11, top surface 109 of unit 35, which in operation is plane and horizontal, is formed with five through orifices 112 each communicating with one of the five junctions 91 by way of one of each of the valves 14, 26, 29, 24, 16 respectively and respective cast internal passages in the unit 35.

The five orifices 112 register with five orifices forming one each the respective outlet of the passages 13, 23, 28, 66, 47 through a bottom plane horizontal surface of the mounting plate 34.

Around each orifice 112 the surface 109 is formed with an annular groove 114 receiving a ring gasket 116.

As hereinbefore described the unit 35 is connected to member **3*a* of the boiler support frame 3. In operation the mounting plate 34 which forms part of the actual boiler releasably supported on the member 3*a*, bears by way of its bottom surface 113 on the top surface 109 of the unit 35 with compression of the seals 116. By the very nature of this assembly by juxtaposition each orifice 112 is sealingly connected to the corresponding internal passage of the mounting plate 34. Consequently, after the plumbing connections have been made between the various systems and the unit 35 on the member 3** in the absence of the boiler itself, the subsequent assembly thereof automatically effects its complete connection.

As will have been understood throughout the description, the mounting plate and the junction unit according to the invention greatly facilitate assembly and maintenance and obviate many malfunctioning risks, particularly the risk of leakages.

I claim:

1. A gas-fired boiler comprising: a burner connected to a gas supply path; a combustion chamber adjacent said burner; a heat exchanger located in said combustion chamber and connected to cold water inlet and hot water outlet paths of a space-heating circuit, said heat exchanger being adapted to transfer heat from a combustion gas produced by said burner to water flowing from said cold water inlet path to said hot water outlet path through said heat exchanger; a hot water service path; distribution, heat exchange and control components in said paths; and a set of inlet and outlet junctions for connection of the paths with exterior piping, wherein the gas supply path, the cold water inlet and hot water outlet paths and the hot water service path are each embodied at least to some extent as internal passages in common mounting plate disposed between the burner and the set of junctions; and the distribution, heat exchange and control components comprise an individual part releasably secured to the mounting plate.

2. A boiler according to claim 1 wherein the individual parts of the components mounted on the mounting plate are all demountable from the same surface thereof.

3. A boiler according to claim 1 wherein the mounting plate is a metal casting.

4. A boilder according to claim 1 wherein the set of junctions takes the form of a junction unit comprising a casting secured to a boiler support frame.

5. A boiler according to claim 1 wherein the set of junctions comprises a body secured to a boiler support frame and formed in its top surface with orifices, the same communicating with the internal passages of the mounting plate by juxtaposition of a bottom surface of the mounting plate, through which surface a number of internal passages extend, with the top surface of the set of junctions.

6. A boiler according to claim 5, comprising means for introducing a gasket between the mounting plate and the body of the set of junctions around each orifice in such set.

7. A gas-fired boiler comprising: a burner connected to a gas supply path; a combustion chamber adjacent said burner; a heat exchanger located in said combustion chamber and connected to cold water inlet and hot water outlet paths of a space-heating circuit, said heat exchanger being adapted to transfer heat from a combustion gas produced by said burner to water flowing from said cold water inlet path to said hot water outlet path through said heat exchanger; a hot water service path; distribution, heat exchange and control components in said paths; and a set of inlet and outlet junctions for connection of the paths with exterior piping, wherein the gas supply path, the cold water inlet and hot water outlet paths and the hot water service path are each embodied at least to some extent as internal passages in a common mounting plate disposed between the burner and the set of junctions; and the distribution, heat exchange and control components comprise an individual part releasably secured to the mounting plate; and wherein the set of junctions is a junction unit comprising a casting which is a part separate from the mounting plate and secured to a boiler support frame.

8. A boiler according to claim 7, wherein the individual parts of the components mounted on the mounting plate are all demountable from the same surface thereof.

9. A boiler according to claim 7, wherein the mounting plate is a metal casting.

10. A gas-fired boiler comprising: a burner connected to a gas supply path; a combustion chamber adjacent said burner; a heat exchanger located in said combustion chamber and connected to cold water inlet and hot water outlet paths of a space-heating circuit, said heat exchanger being adapted to transfer heat from a combustion gas produced by said burner to water flowing from said cold water inlet path to said hot water outlet path through said heat exchanger; a hot water service path; disbribution, heat exchange and control components in said paths; and a set of inlet and outlet junctions for connection of the paths with exterior piping, wherein the gas supply path, the cold water inlet and hot water outlet paths and the hot water service path are each embodied at least to some extent as internal passages in a common mounting plate disposed between the burner and the set of junctions; and the distribution, heat exchange and control components comprise an individual part releasably secured to the mounting plate; and wherein the set of junctions comprises a body secured to a boiler support frame and formed in its top surface with orifices, the same communicating with the internal passages of the mounting plate by juxtaposition of a bottom surface of the mounting plate, through which surface a number of internal passages extend, with the top surface of the set of junctions.

11. A boiler according to claim 10, wherein the individual parts of the components mounted on the mounting plate are all demountable from the same surface thereof.

12. A boiler according to claim 10, wherein the mounting plate is a metal casting.

13. A boiler according to claim 10, comprising means for introducing a gasket between the mounting plate and the body of the set of junctions around each orifice in such set.

* * * * *